US011526096B2

(12) United States Patent
Nohara

(10) Patent No.: US 11,526,096 B2
(45) Date of Patent: Dec. 13, 2022

(54) DEVELOPER STORAGE CONTAINER CAPABLE OF ELIMINATING OR MINIMIZING HEAT TRANSFER, IMAGE FORMING APPARATUS

(71) Applicant: KYOCERA Document Solutions Inc., Osaka (JP)

(72) Inventor: Yuta Nohara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/703,802

(22) Filed: Mar. 24, 2022

(65) Prior Publication Data

US 2022/0334512 A1 Oct. 20, 2022

(30) Foreign Application Priority Data

Apr. 19, 2021 (JP) ..... JP2021-070503

(51) Int. Cl.
*G03G 15/08* (2006.01)

(52) U.S. Cl.
CPC ..... *G03G 15/0865* (2013.01)

(58) Field of Classification Search
CPC ..... G03G 15/0863; G03G 15/0865; G03G 15/0872; G03G 15/087; G03G 15/0886
USPC ..... 399/252, 258, 262
See application file for complete search history.

(56) References Cited

U.S. PATENT DOCUMENTS 10,976,686 B2 * 4/2021 Takami ..... G03G 15/0886
2007/0077100 A1 4/2007 Suzuki et al.

FOREIGN PATENT DOCUMENTS

JP 2005221825 A 8/2005
JP 2016066037 * 4/2016

* cited by examiner

*Primary Examiner* — Hoan H Tran
(74) *Attorney, Agent, or Firm* — Alleman Hall Creasman & Tuttle LLP

(57) ABSTRACT

A developer storage container includes a storage portion, a communication portion, and a gear portion. The storage portion conveys developer stored therein in a conveying direction along a rotation axis by being rotated around the rotation axis in a specific direction. The communication portion is tubular coaxial to the rotation axis and extending in the conveying direction from a downstream end in the conveying direction, and connects the storage portion to an opening portion facing the conveying direction. The gear portion includes a disc-shaped support portion provided for an outer peripheral part of the communication portion concentrically with the rotation axis, a tooth portion along an edge of a support surface, orthogonal to the rotation axis, of the support portion, and a rib extending on the support surface radially from the tooth portion or the outer peripheral part without reaching the other; and receives rotational driving force supplied from outside.

5 Claims, 13 Drawing Sheets

DEVELOPER STORAGE CONTAINER CAPABLE OF ELIMINATING OR MINIMIZING HEAT TRANSFER, IMAGE FORMING APPARATUS

INCORPORATION BY REFERENCE

This application is based upon and claims the benefit of priority from the corresponding Japanese Patent Application No. 2021-070503 filed on Apr. 19, 2021, the entire contents of which are incorporated herein by reference.

BACKGROUND

The present disclosure relates to a developer storage container and an image forming apparatus.

An image forming apparatus, such as a printer, capable of forming images by an electrophotographic method includes a developer storage container that stores developer such as toner. The developer storage container includes a tubular storage portion. The storage portion conveys the developer stored therein in a conveying direction parallel to a rotation axis by being rotated around the rotation axis parallel to a horizontal plane in a specific direction.

In addition, a known developer storage container in a related art includes a gear portion downstream of the storage portion in the conveying direction to transmit a rotational driving force supplied from the outside to the storage portion. The developer storage container according to the related art includes a communication portion that supports the gear portion and that connects the storage portion to an opening portion through which the developer is discharged in the conveying direction.

SUMMARY

A developer storage container according to an aspect of the present disclosure, positioned such that a rotation axis of the developer storage container is parallel to a horizontal plane during use, includes a storage portion, a communication portion, and a gear portion. The storage portion conveys developer stored inside the storage portion in a conveying direction parallel to the rotation axis by being rotated around the rotation axis in a specific direction. The communication portion has a tubular shape coaxial to the rotation axis and extending in the conveying direction from an end of the storage portion on a downstream side in the conveying direction. The communication portion connects the storage portion to an opening portion that has an opening facing the conveying direction. The gear portion includes a support portion having a disc shape and provided for an outer peripheral part of the communication portion to be concentric with the rotation axis, a tooth portion extending along an edge of a support surface, orthogonal to the rotation axis, of the support portion, and a rib extending on the support surface radially from one of the tooth portion and the outer peripheral part of the communication portion without reaching the other. The gear portion receives a rotational driving force supplied from the outside.

An image forming apparatus according to another aspect of the present disclosure includes the developer storage container and an image forming portion. The image forming portion forms an image using the developer supplied from the developer storage container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
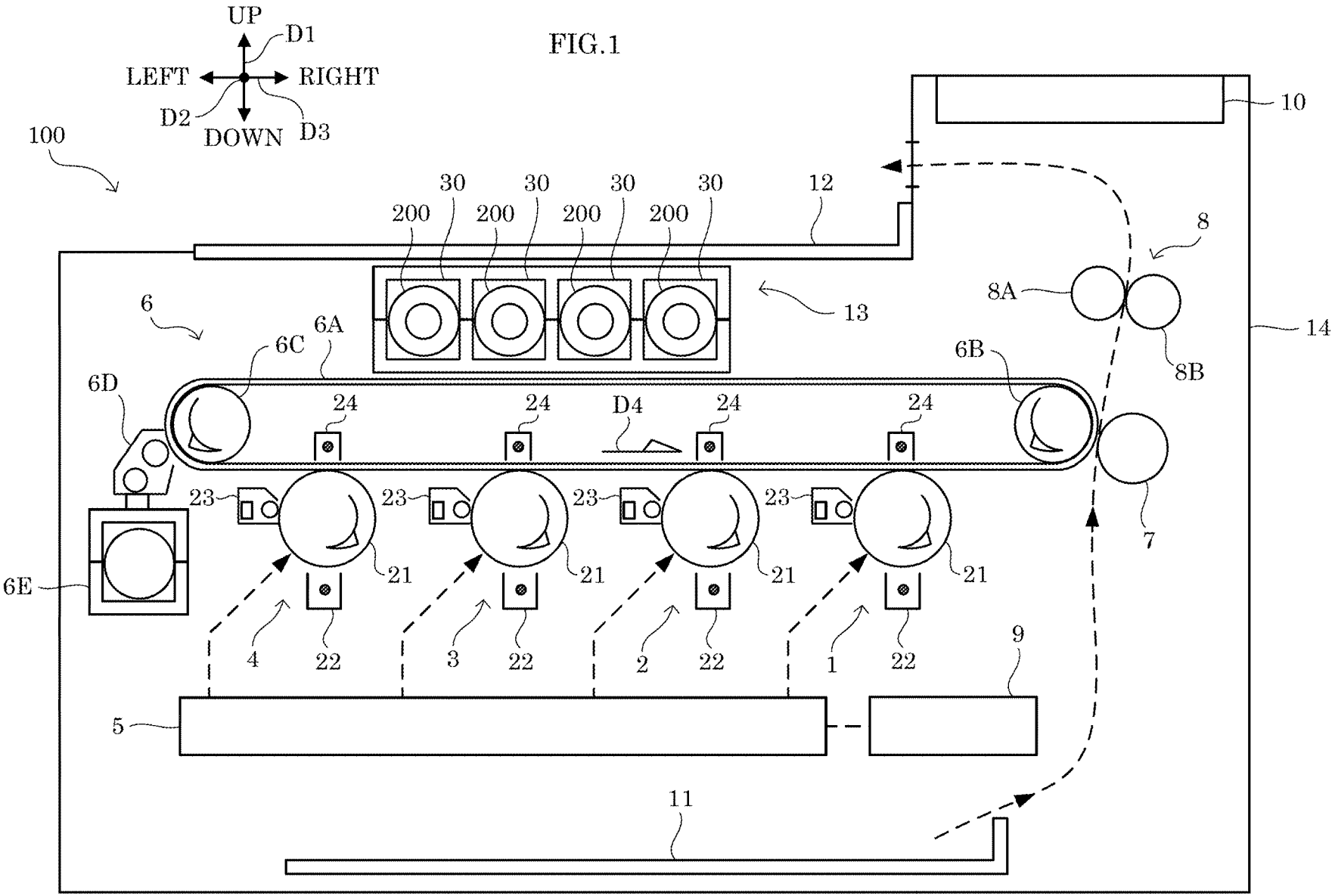
FIG. 1 is a cross-sectional view showing a configuration of an image forming apparatus according to an embodiment of the present disclosure.

The following describes embodiments of the present disclosure with reference to the accompanying drawings. It should be noted that the following embodiments are examples of specific embodiments of the present disclosure and should not limit the technical scope of the present disclosure.

[Configuration of Image Forming Apparatus 100]

First, a configuration of an image forming apparatus 100 according to an embodiment of the present disclosure will be described with reference to FIG. 1.

In the description below, an up-down direction D1 is defined relative to the image forming apparatus 100 in an installed state. In addition, a front-rear direction D2 is defined on the premise that a side of the image forming apparatus 100 from which toner containers 200 are inserted serves as the near side (front side). In addition, a left-right direction D3 is defined on the premise that the image forming apparatus 100 is viewed from the near side (front side).

The image forming apparatus 100 has at least a print function. The image forming apparatus 100 prints images on printing sheets serving as sheet members using developer containing toner (an example of developer of the present disclosure). For example, the image forming apparatus 100 is a color printer. Alternatively, the image forming apparatus 100 may be a monochrome printer or may be a facsimile apparatus, a copier, or a multifunction peripheral.

The image forming apparatus 100 is a color image forming apparatus of a so-called tandem type. As shown in FIG. 1, the image forming apparatus 100 includes image forming portions 1 to 4, a laser scanning unit 5, an intermediate transfer unit 6, a secondary transfer device 7, a fixing device 8, a control portion 9, an operation display portion 10, a sheet feed tray 11, a sheet discharge tray 12, and a toner supply portion 13. These components are installed in a housing 14 that constitutes, for example, an outer frame (not shown) and an inner frame of the image forming apparatus 100.

The image forming portions 1 to 4 form toner images of different colors on a plurality of photoconductor drums 21 arranged in parallel by a so-called electrophotographic method. The toner images are sequentially transferred and superposed onto a traveling (moving) intermediate transfer belt 6A. As shown in FIG. 1, the image forming portions 1 to 4 include the image forming portion 1 for black, the image forming portion 2 for yellow, the image forming portion 3 for cyan, and the image forming portion 4 for magenta aligned in this order from the downstream side in a moving direction D4 of the intermediate transfer belt 6A.

The image forming portions 1 to 4 are disposed under the intermediate transfer belt 6A. The image forming portions 1 to 4 each include the photoconductor drum 21 that carries a toner image, a charging device 22, a developing device 23, and a primary transfer device 24. In each of the image forming portions 1 to 4, the surface of the photoconductor drum 21 is electrically charged by the charging device 22, and the charged surface of the photoconductor drum 21 is exposed to a laser beam scanned by the laser scanning unit 5. This forms electrostatic latent images on the surface of the photoconductor drum 21. The developing device 23 develops the electrostatic latent images using toner. The primary transfer device 24 transfers the toner images on the photoconductor drum 21 to the intermediate transfer belt 6A.

The intermediate transfer unit 6 includes the intermediate transfer belt 6A, a drive roller 6B, a driven roller 6C, and a belt cleaning device 6D. The intermediate transfer belt 6A carries toner images composed of toner images of multiple (four in the present embodiment) colors. The intermediate transfer belt 6A is supported by the drive roller 6B and the driven roller 6C to be rotationally driven, thereby being movable while the surface thereof is in contact with the surfaces of the photoconductor drums 21. When the intermediate transfer belt 6A is rotationally driven, the surface thereof passes through spaces between the photoconductor drums 21 and the corresponding primary transfer devices 24. At this time, the toner images of multiple colors carried by the photoconductor drums 21 are sequentially transferred and superposed onto the intermediate transfer belt 6A.

The toner supply portion 13 is disposed above the intermediate transfer unit 6. The toner supply portion 13 supplies the image forming portions 1 to 4 with toner of corresponding colors.

The secondary transfer device 7 transfers the toner images that have been transferred to the intermediate transfer belt 6A to printing sheets conveyed from the sheet feed tray 11. The printing sheets to which the toner images are transferred are conveyed to the fixing device 8 by a conveying portion (not shown). The fixing device 8 includes a heating roller 8A and a pressure roller 8B. The fixing device 8 conveys the printing sheets to which the toner images are transferred while applying heat and pressure to the printing sheets. This causes the toner images to be fused and fixed to the printing sheets. The printing sheets to which the toner images are fixed are conveyed further downstream and then discharged and kept on the sheet discharge tray 12 with a flat open shape disposed above the intermediate transfer unit 6.

The belt cleaning device 6D removes and collects waste toner remaining on the surface of the intermediate transfer belt 6A and discharges the collected waste toner to a waste toner container 6E.

The control portion 9 includes control devices such as a CPU, a ROM, a RAM, and an EEPROM (all not shown). The CPU is a processor that executes various types of calculation processes. The ROM is a nonvolatile storage device that stores in advance information including control programs to cause the CPU to execute various types of processing. The RAM is a volatile or nonvolatile storage device. The EEPROM is a nonvolatile storage device. The RAM and the EEPROM are used as a temporary memory (work area) for the various types of processing executed by the CPU. In the control portion 9, the CPU executes the various types of control programs stored in the ROM in advance. Thus, the control portion 9 provides integrated control over the image forming apparatus 100. The control portion 9 may be composed of an electronic circuit such as an integrated circuit (ASIC) or may be provided separately from a main control portion that provides integrated control over the image forming apparatus 100.

The operation display portion 10 includes a display portion and an operation portion. The display portion includes a liquid crystal display and displays various types of information according to control instructions from the control portion 9. The operation portion includes operation keys and a touch panel for inputting various types of information to the control portion 9 according to user operations.

[Configuration of Toner Supply Portion 13]

Next, the toner supply portion 13 will be described with reference to FIGS. 1 to 10.

As shown in FIG. 1, the toner supply portion 13 includes the toner containers 200 (an example of a developer storage container of the present disclosure) respectively corresponding to multiple colors of black, yellow, cyan, and magenta and installation portions 30 in which the toner containers 200 are installed.

Figure 2:
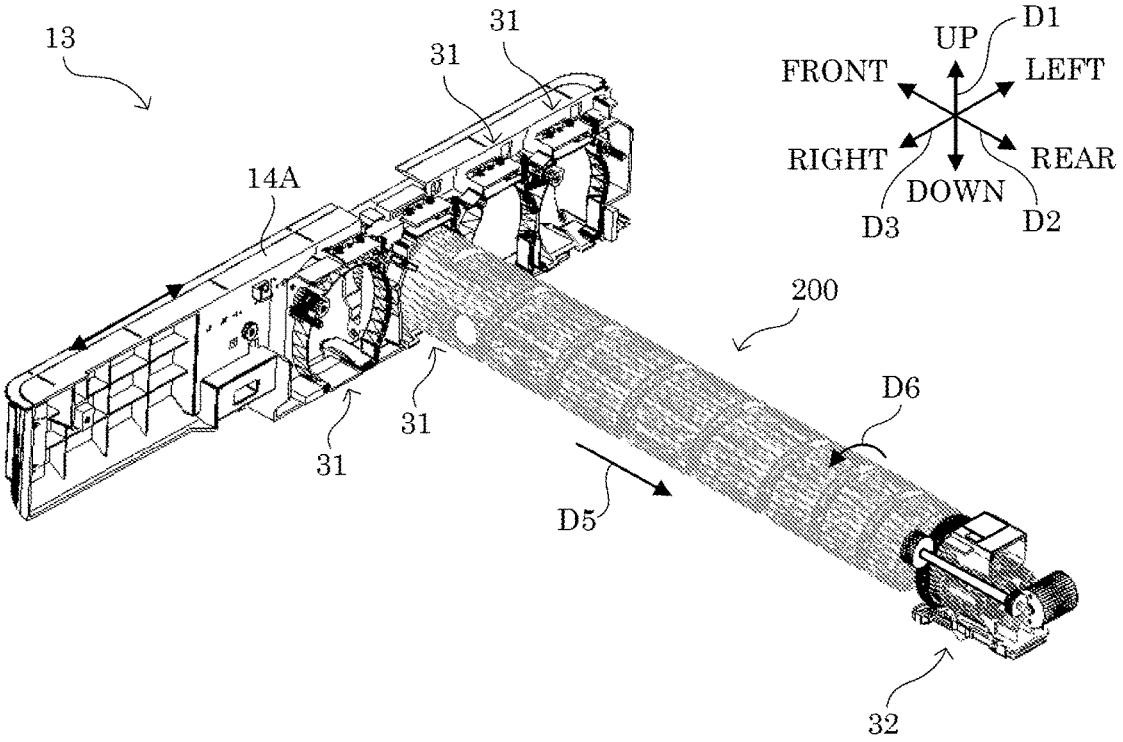
FIG. 2 is a perspective view showing a configuration of a toner supply portion of the image forming apparatus according to the embodiment of the present disclosure.
Figure 5:
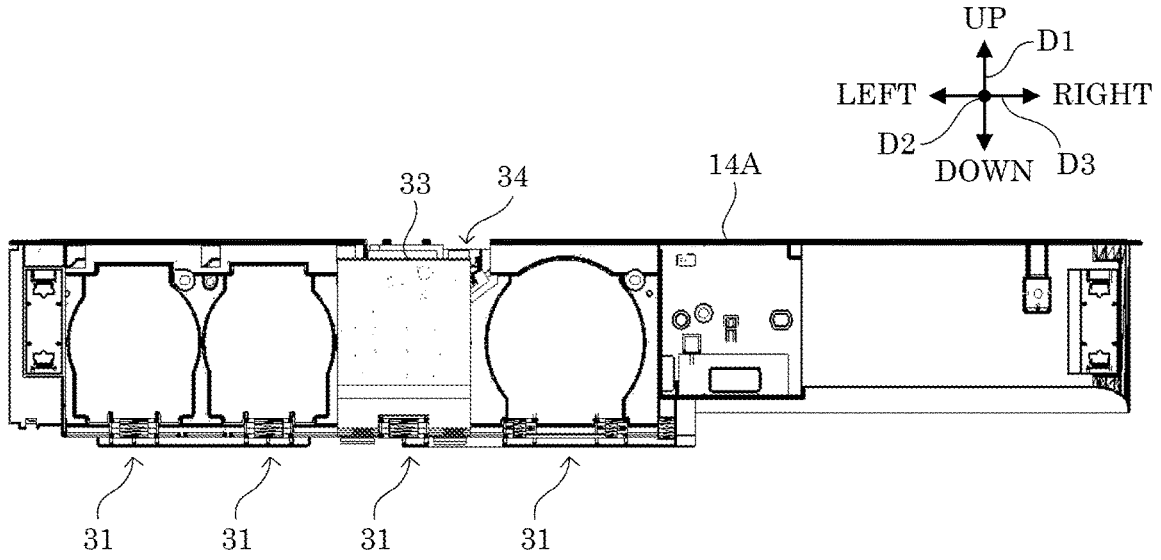
FIG. 5 is a front view showing a configuration of insertion hole portions of the image forming apparatus according to the embodiment of the present disclosure.

As shown in FIGS. 2 and 5, the toner supply portion 13 further includes insertion hole portions 31, drive portions 32, and lock covers 33.

Figure 7:
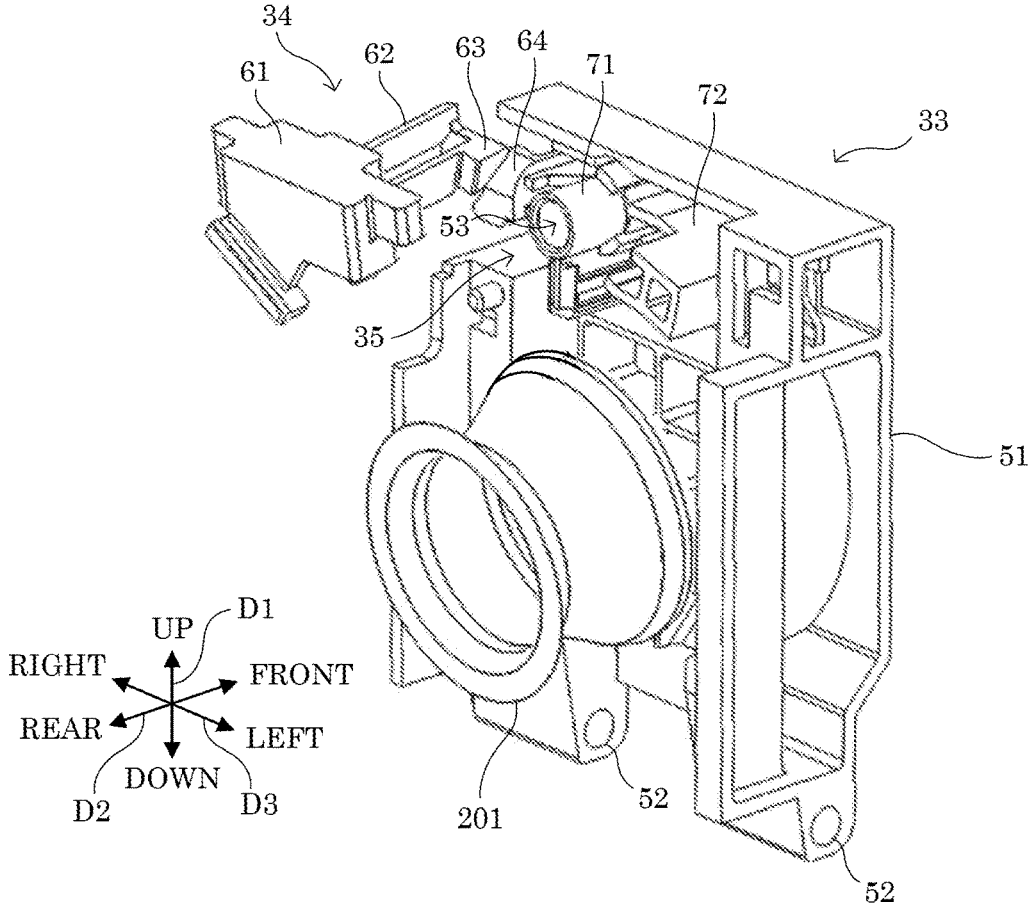
FIG. 7 is a perspective view showing a configuration of and around a locking mechanism of the image forming apparatus according to the embodiment of the present disclosure.

As shown in FIG. 7, the toner supply portion 13 further includes locking mechanisms 34 and unlocking portions 35.

The toner containers 200 store toner to be supplied to the developing devices 23. In the present embodiment, the four toner containers 200 corresponding to the multiple colors of black, yellow, cyan, and magenta are provided for the toner supply portion 13. FIG. 2 shows only the toner container 200 for yellow, and illustration of the toner containers 200 for the other colors is omitted. FIG. 5 shows only the lock cover 33 and the locking mechanism 34 corresponding to the toner container 200 for yellow, and illustration of the lock covers 33 and the locking mechanisms 34 corresponding to the toner containers 200 for the other colors is omitted. The toner containers 200 for the multiple colors have a common configuration except that the toner container 200 for black has a larger outside diameter than the toner containers 200 for the other colors. Unless otherwise noted, the toner container 200 and the configuration corresponding to the toner container 200 described below are of the toner container 200 for yellow shown in FIG. 2.

Figure 3:
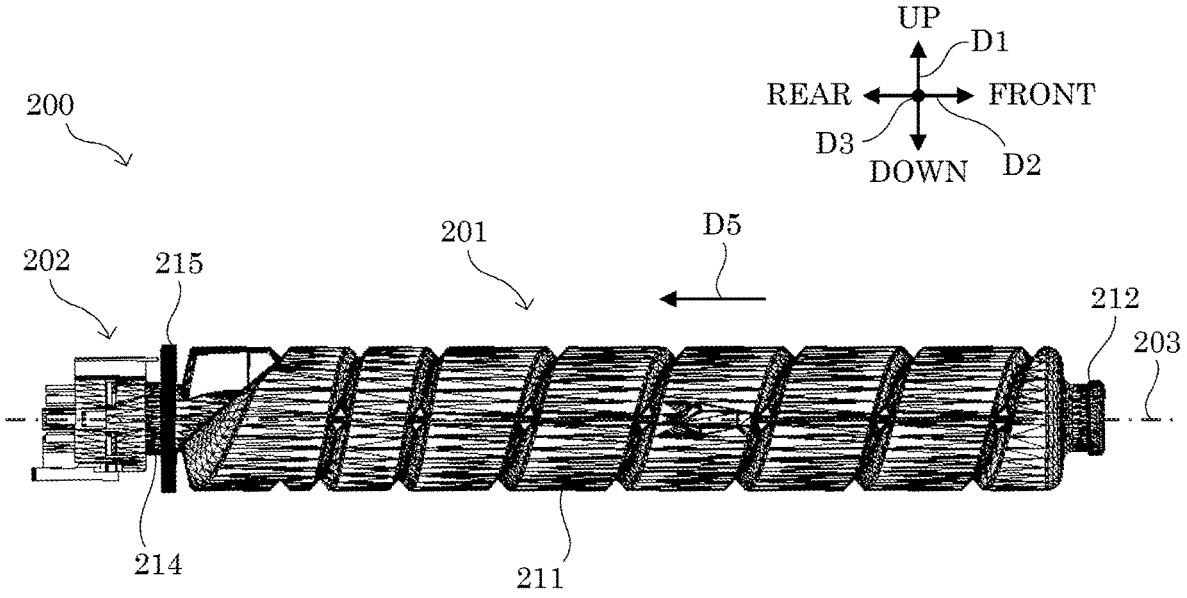
FIG. 3 is a side view showing a configuration of a toner container of the image forming apparatus according to the embodiment of the present disclosure.

As shown in FIG. 3, the toner container 200 includes a container body 201 and a cap portion 202.

The container body 201 stores toner and conveys the toner in a conveying direction D5 (see FIG. 3). The conveying direction D5 is a direction from the front to the rear of the image forming apparatus 100. The container body 201 is integrally formed from synthetic resin such as polyethylene terephthalate (PET). For example, the container body 201 includes a communication portion 214, a gear portion 215, and an opening portion 216 (see FIG. 4) formed by injection molding. In addition, the container body 201 includes a storage portion 211 and a grip portion 212 formed by injection blow molding.

Figure 4:
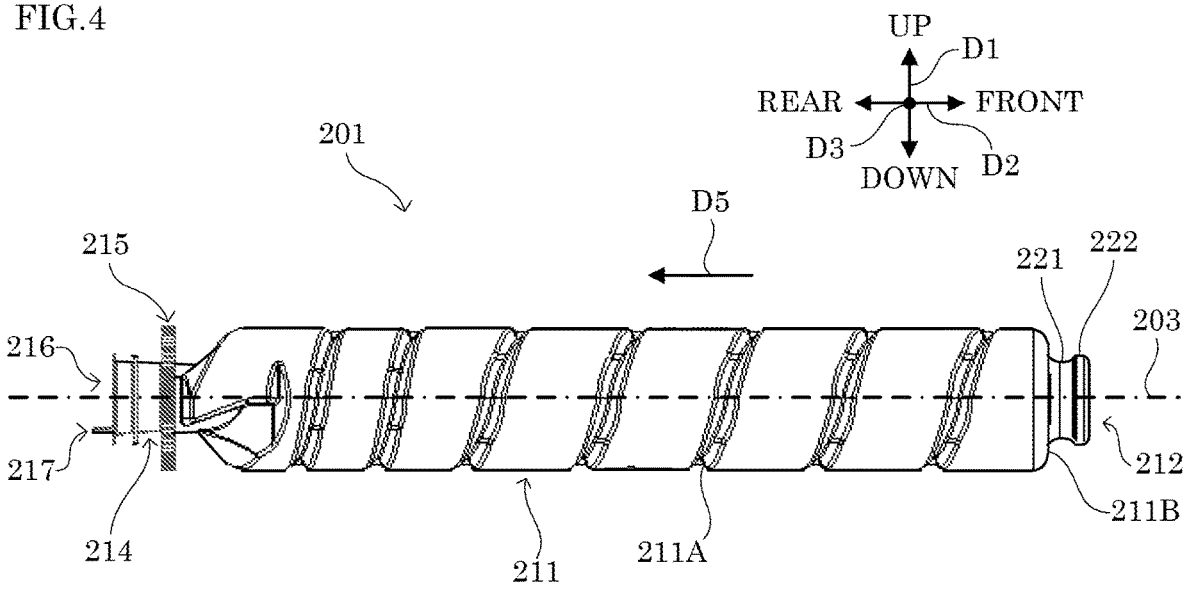
FIG. 4 is a side view showing a configuration of a container body of the image forming apparatus according to the embodiment of the present disclosure.

As shown in FIG. 4, the container body 201 includes the storage portion 211, the grip portion 212, the communication portion 214, the gear portion 215, and the opening portion 216.

The storage portion 211 has a tubular shape coaxial to the rotation axis 203 (see FIGS. 3 and 4) of the toner container 200. Specifically, the storage portion 211 is cylindrical. The storage portion 211 stores therein toner to be supplied.

The container body 201 of the toner container 200 is rotatable around the rotation axis 203. The storage portion 211 includes a protrusion 211A (see FIG. 4) extending helically in an inner peripheral part thereof along the rotation axis 203. FIG. 4 shows a helical recess, corresponding to the protrusion 211A, formed in an outer peripheral part of the storage portion 211. Due to the helical protrusion 211A formed inside, the storage portion 211 can convey the toner stored therein in the conveying direction D5 along the rotation axis 203 by rotating around the rotation axis 203 in a first direction D6 (an example of a specific direction of the present disclosure; see FIG. 2).

The grip portion 212 is disposed at an end of the container body 201 on the upstream side in the conveying direction D5. The grip portion 212 is a part gripped by a user's hand when the toner container 200 is pulled forward out of the insertion hole portion 31 (see FIGS. 2 and 5). The toner container 200 is inserted into the insertion hole portion 31 with the leading end in the conveying direction D5 facing backward.

As shown in FIG. 4, the grip portion 212 protrudes upstream in the conveying direction D5 from an end face 211B of the storage portion 211 on the upstream side in the conveying direction D5. Specifically, the grip portion 212 has a cylindrical shape coaxial to the rotation axis 203 and protrudes from the end face 211B. The grip portion 212 is hollow, and the interior space communicates with the storage portion 211. The grip portion 212 stores therein the toner to be supplied.

The distal end of the grip portion 212 is expanded in radial directions, which are orthogonal to the rotation axis 203, compared with the proximal end of the grip portion 212. Specifically, as shown in FIG. 4, the grip portion 212 includes a small diameter portion 221 and a large diameter portion 222. The small diameter portion 221 is disposed at the proximal end portion of the grip portion 212. The large diameter portion 222 is disposed at the distal end of the grip portion 212. The large diameter portion 222 adjoins the small diameter portion 221. The large diameter portion 222 has a larger diameter than the small diameter portion 221. The grip portion 212 formed as above enables the user to pull the toner container 200 out of the insertion hole portion 31 by holding the large diameter portion 222 with their fingers. It is noted that the grip portion 212 may be expanded in radial directions from the proximal end to the distal end gradually in any given steps. In addition, the grip portion 212 may be continuously expanded in radial directions from the proximal end to the distal end.

The opening portion 216 is disposed at an end of the container body 201 on the downstream side in the conveying direction D5. The opening portion 216 has an opening facing the conveying direction D5 parallel to the rotation axis 203. The toner inside the container body 201 is discharged from the opening portion 216 in the conveying direction D5.

The communication portion 214 has a tubular shape coaxial to the rotation axis 203 and extends in the conveying direction D5 from an end of the storage portion 211 on the downstream side in the conveying direction D5. Specifically, as shown in FIG. 4, the communication portion 214 has a tubular shape with a diameter smaller than that of the storage portion 211. The communication portion 214 connects the space inside the storage portion 211 to the opening portion 216. The opening portion 216 has the same size as an end of the communication portion 214 on the downstream side in the conveying direction D5. The opening portion 216 substantially corresponds to the end of the communication portion 214 on the downstream side in the conveying direction D5.

Figure 13:
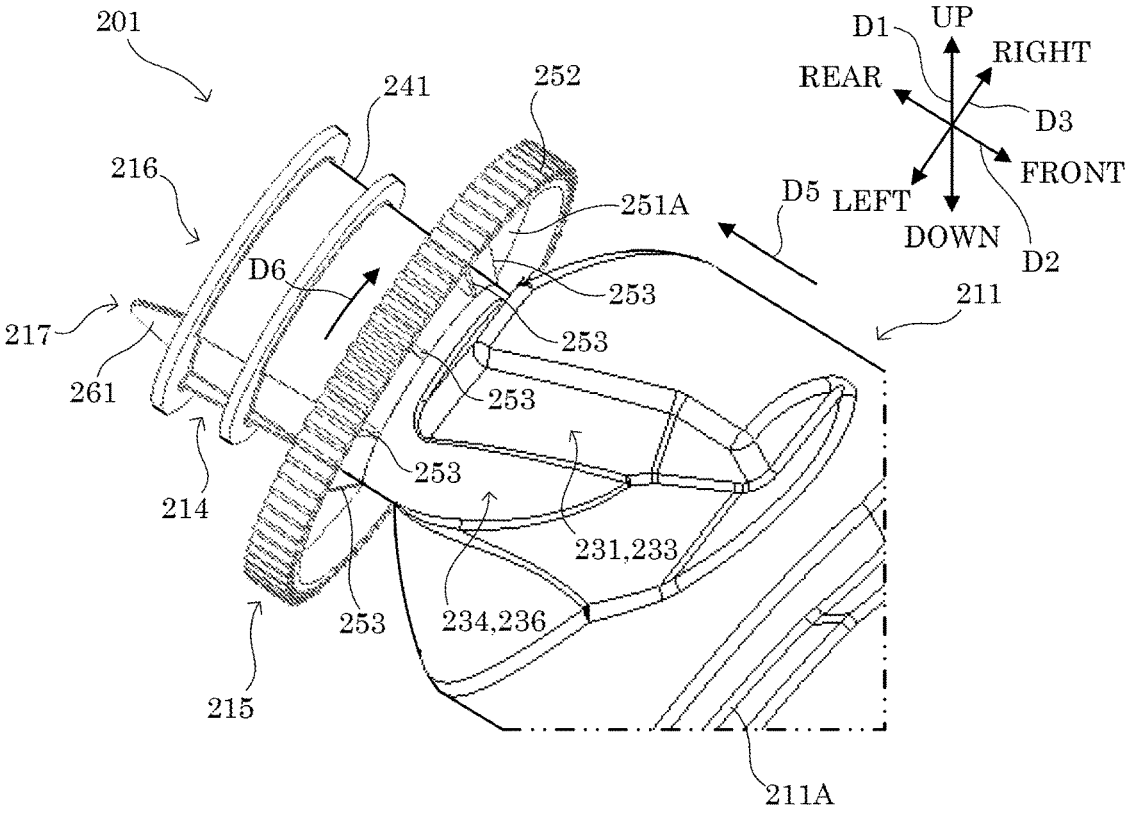
FIG. 13 is a perspective view showing a configuration of a scooping portion of the image forming apparatus according to the embodiment of the present disclosure.

The gear portion 215 is provided for an outer peripheral part 241 of the communication portion 214 (see FIG. 13).

The gear portion 215 receives a rotational driving force supplied by the drive portion 32. The components including the gear portion 215 are integrally molded into the container body 201. Accordingly, when the gear portion 215 receives the rotational driving force supplied by the drive portion 32, the container body 201 rotates around the rotation axis 203.

The cap portion 202 is attached to the rear end of the container body 201, that is, the opening portion 216. The cap portion 202 has a tubular shape with a bottom and has a size capable of covering part of the communication portion 214 including the opening portion 216.

Figure 22:
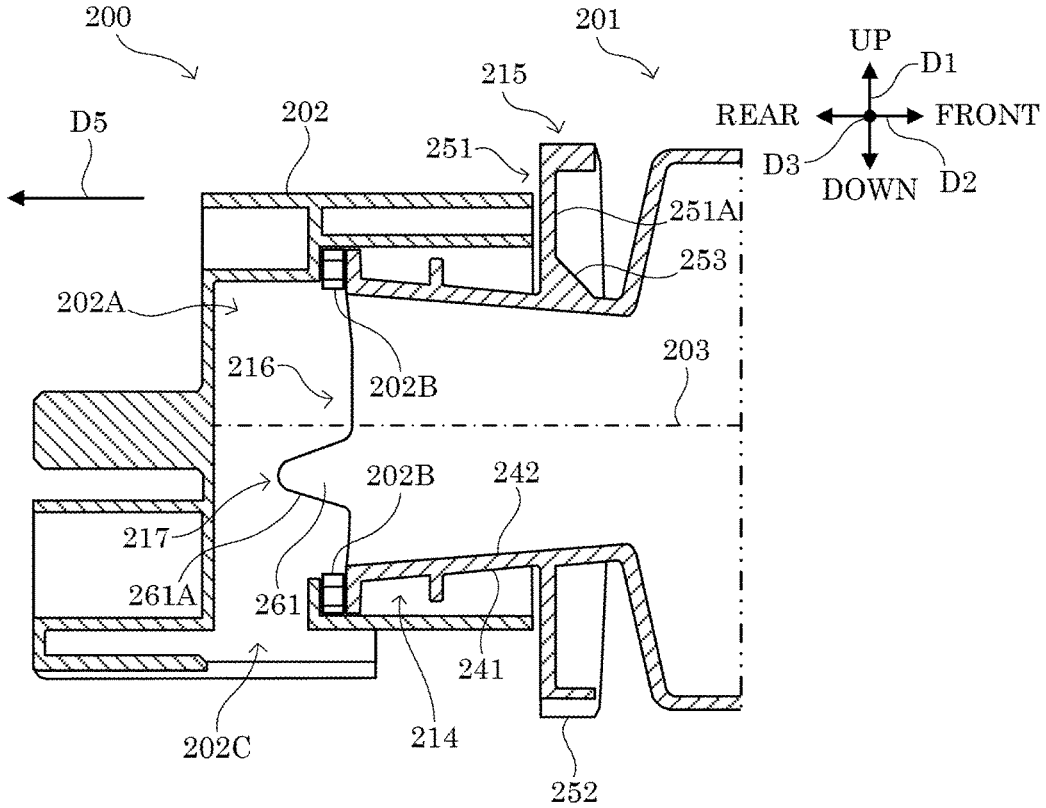
FIG. 22 is a cross-sectional view showing the configuration of the toner container of the image forming apparatus according to the embodiment of the present disclosure.

The cap portion 202 is located downstream of the opening portion 216 in the conveying direction D5 and guides the toner discharged from the opening portion 216 downward. The cap portion 202 includes a guide space 202A (see FIG. 22) that guides the toner discharged from the opening portion 216 downward. The guide space 202A is formed by an inner peripheral part of the cap portion 202 and the inner wall surface facing the opening portion 216. Inside the cap portion 202, a gap left between the opening portion 216 and the cap portion 202 is closed with a seal member 202B (see FIG. 22). The cap portion 202 includes an outlet 202C (see FIG. 22) at the bottom of the inner peripheral part to discharge the toner to the outside of the cap portion 202.

The toner containers 200 are installed in the installation portions 30. The installation portions 30 correspond to the respective toner containers 200. The installation portions 30 form storage spaces for the toner containers 200 extending in the front-rear direction D2 inside the housing 14. The toner containers 200 are installed in the installation portions 30 such that the rotation axes 203 are parallel to a horizontal plane.

The insertion hole portions 31 are disposed in a side face of the housing 14 of the image forming apparatus 100. Specifically, the insertion hole portions 31 are disposed in the front (on the front face) of the housing 14. A lock frame 14A (see FIG. 5) elongated in the left-right direction D3 is disposed in the front of the housing 14. The insertion hole portions 31 are formed in the lock frame 14A. The insertion hole portions 31 correspond to the respective installation portions 30. The insertion hole portions 31 are located at the front ends of the installation portions 30 and communicate with the installation portions 30. The toner containers 200 are inserted into the insertion hole portions 31.

The drive portions 32 rotate the container bodies 201 of the toner containers 200. The drive portions 32 correspond to the respective installation portions 30. The drive portions 32 are disposed at the rear ends of the installation portions 30 (see FIG. 2).

Figure 6:
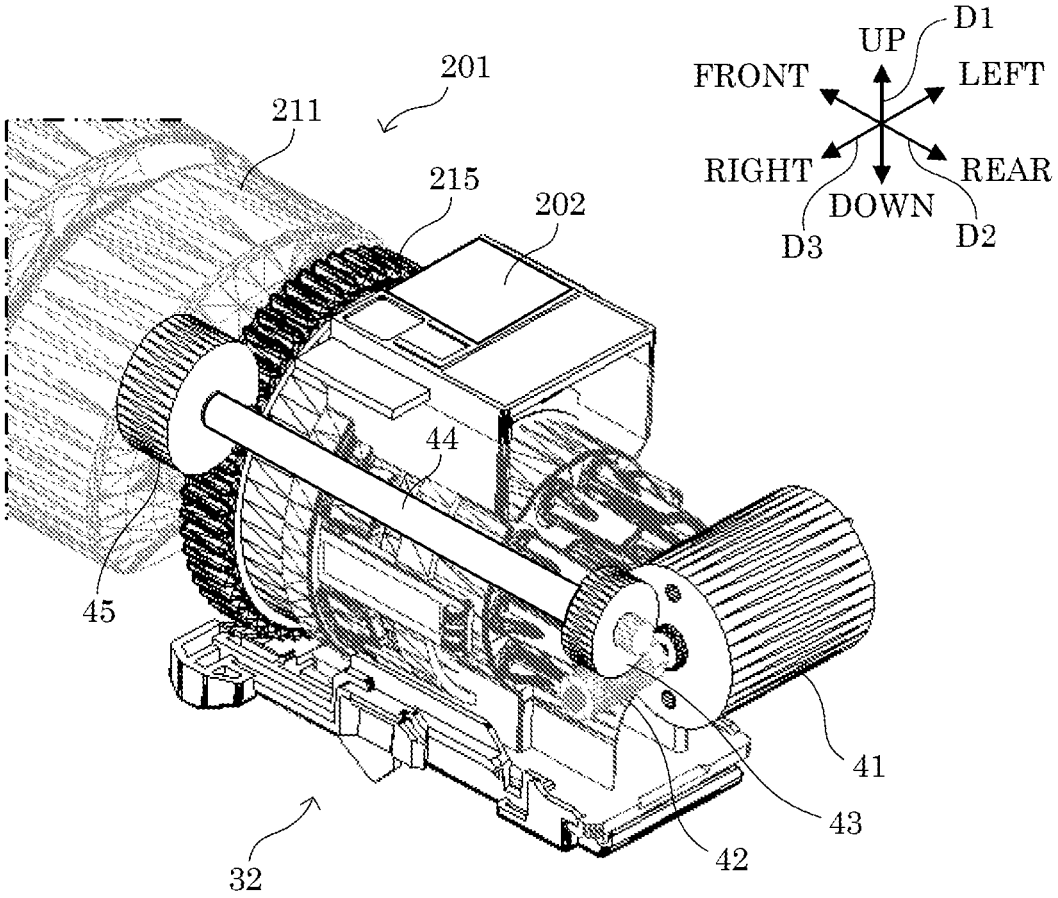
FIG. 6 is a perspective view showing a configuration of a drive portion of the image forming apparatus according to the embodiment of the present disclosure.

As shown in FIG. 6, each of the drive portions 32 includes a motor 41, a first gear 42, a second gear 43, a shaft 44, and a third gear 45. The first gear 42 is secured to the drive shaft of the motor 41. The second gear 43 is secured to a first end of the shaft 44 and meshes with the first gear 42. The shaft 44 is rotatably supported by a bearing (not shown) inside the housing 14. The third gear 45 is secured to a second end of the shaft 44 and meshes with the gear portion 215 of the corresponding container body 201.

In the drive portion 32, the rotational driving force generated by the motor 41 is transmitted to the gear portion 215 through the first gear 42, the second gear 43, the shaft 44, and the third gear 45. This causes the container body 201 to rotate around the rotation axis 203.

The lock covers 33 open and close the insertion hole portions 31. The lock covers 33 correspond to the respective insertion hole portions 31. As shown in FIG. 5, the lock covers 33 are disposed on the front side of the lock frame 14A.

As shown in FIG. 7, each of the lock covers 33 includes a flat portion 51, bearing portions 52, and a pivot shaft 53. The flat portion 51 functions as a cover that is put on the corresponding insertion hole portion 31. The bearing portions 52 support the lock cover 33 such that the lock cover 33 can be opened and closed. The bearing portions 52 are disposed in a lower part of the flat portion 51, and a rotation shaft extending in the left-right direction D3 is placed through the bearing portions 52. The rotation shaft is secured in a lower part of the lock frame 14A. This enables the lock cover 33 to pivot on the rotation shaft between a closed state in which the lock cover 33 closes the insertion hole portion 31 and an open state in which the lock cover 33 opens the insertion hole portion 31. The pivot shaft 53 protrudes from the inner surface (rear face) of the flat portion 51 in the front-rear direction D2 (see FIGS. 9 and 10).

The locking mechanisms 34 impose a restriction on a state change of the lock covers 33 from the closed state to the open state. The locking mechanisms 34 correspond to the respective lock covers 33. As shown in FIG. 5, the locking mechanisms 34 are disposed in an upper part of the lock frame 14A.

Figure 8:
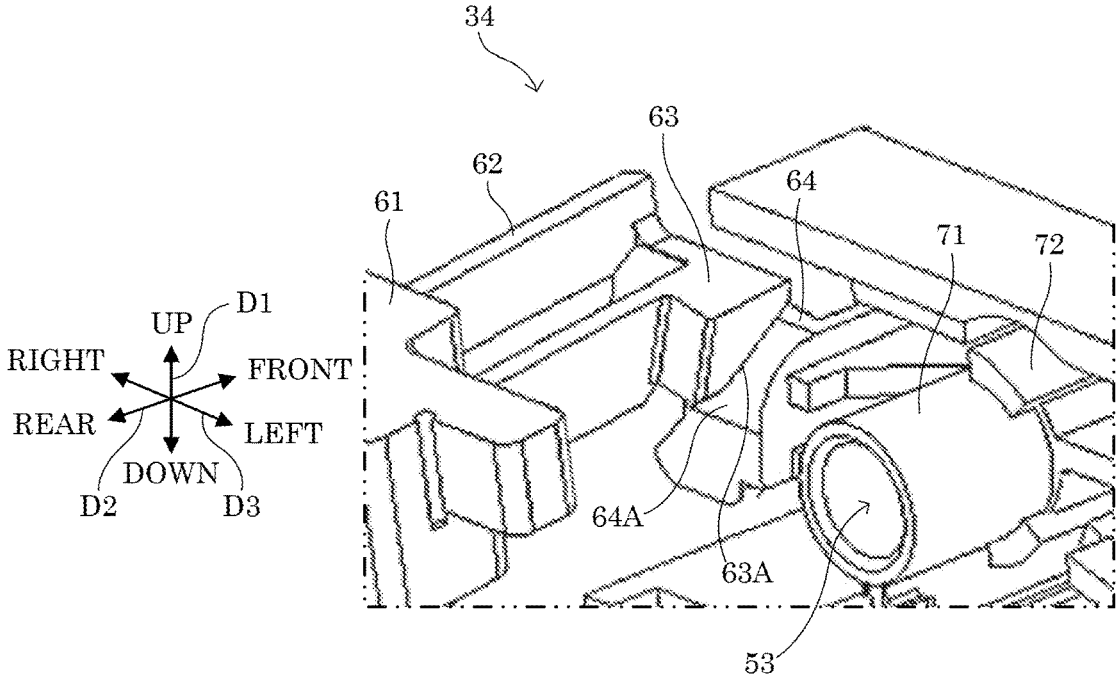
FIG. 8 is a perspective view showing the configuration of and around the locking mechanism of the image forming apparatus according to the embodiment of the present disclosure.

As shown in FIG. 7, each of the locking mechanisms 34 includes an arm support portion 61, an arm portion 62, an engaging portion 63, and an engagement portion 64. The arm support portion 61 is secured to the upper part of the lock frame 14A. The arm portion 62 protrudes forward from the arm support portion 61. The engaging portion 63 protrudes from the protruding end of the arm portion 62 to the left. As shown in FIG. 8, the engaging portion 63 includes an inclined surface 63A facing obliquely forward and downward. The inclined surface 63A is inclined downward from the front end to the rear end of the engaging portion 63. The engagement portion 64 is swingable on the pivot shaft 53 of the lock cover 33. The engagement portion 64 is engageable with the engaging portion 63. As shown in FIG. 8, the engagement portion 64 includes an inclined surface 64A. The inclined surface 64A faces obliquely upward and backward when the lock cover 33 is in the closed state. When the lock cover 33 moves from the open state to the closed state, the inclined surface 64A comes into contact with the inclined surface 63A of the engaging portion 63 and causes the engagement portion 64 to swing downward. Thus, the engagement portion 64 is guided to the rear side of the engaging portion 63, and thereby the engaging portion 63 engages with the engagement portion 64. The engagement of the engaging portion 63 with the engagement portion 64 imposes the restriction on the state change of the lock cover 33 from the closed state to the open state.

The unlocking portions 35 remove the restriction on the state change of the lock covers 33 imposed by the locking mechanisms 34. The unlocking portions 35 correspond to the respective locking mechanisms 34. The unlocking portions 35 are disposed on the inner surfaces (rear faces) of the flat portions 51 of the lock covers 33.

Figure 9:
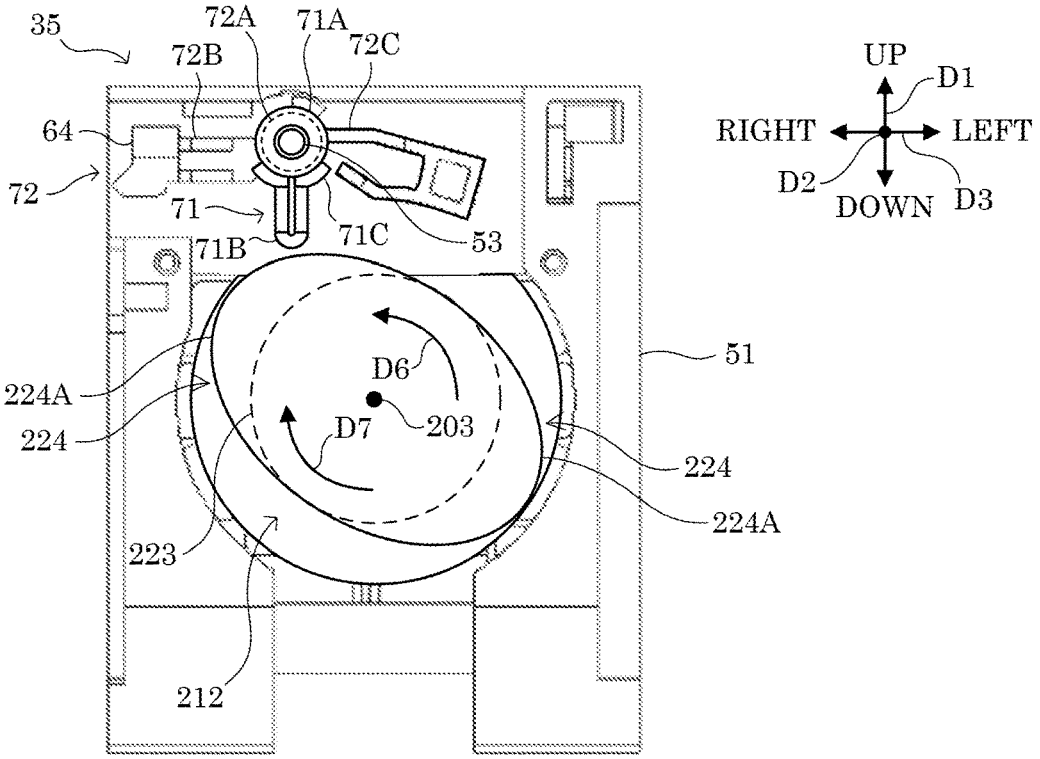
FIG. 9 is a rear view showing a configuration of an unlocking portion of the image forming apparatus according to the embodiment of the present disclosure.
Figure 10:
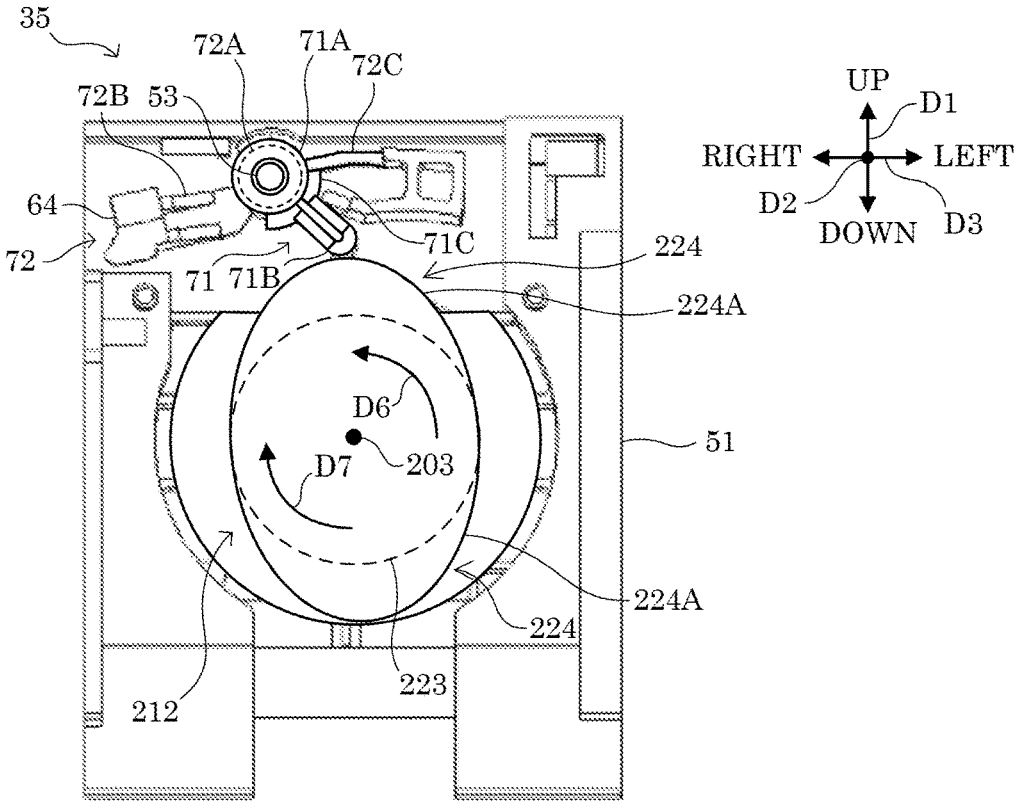
FIG. 10 is a rear view showing the configuration of the unlocking portion of the image forming apparatus according to the embodiment of the present disclosure.

As shown in FIGS. 7 and 9, each of the unlocking portions 35 includes a first lever portion 71 and a second lever portion 72. The first lever portion 71 extends from the pivot shaft 53 (see FIG. 9) parallel to the rotation axis 203 toward the rotation axis 203, and the proximal end of the first lever portion 71 is swingably supported by the pivot shaft 53. As shown in FIG. 9, the first lever portion 71 extends from the pivot shaft 53 to the grip portion 212. As shown in FIG. 9, the first lever portion 71 includes a bearing portion 71A fitted on the pivot shaft 53, an extension portion 71B extending from the bearing portion 71A in a direction orthogonal to the pivot shaft 53, and a pushing portion 71C disposed to the left of the extension portion 71B. The second lever portion 72 is swingable on the pivot shaft 53 and supports the engagement portion 64. The second lever portion 72 is disposed between the first lever portion 71 and the inner surface (rear face) of the flat portion 51. As shown in FIG. 9, the second lever portion 72 includes a bearing portion 72A fitted on the pivot shaft 53, a support portion 72B extending from the bearing portion 72A to the right to support the engagement portion 64, and a pressure receiving portion 72C extending from the bearing portion 72A to the left.

The unlocking portion 35 removes the restriction on the state change of the lock cover 33 imposed by the locking mechanism 34 as the first lever portion 71 swings in a second direction D7 (see FIG. 9) opposite the first direction D6.

Specifically, the extension portion 71B of the first lever portion 71 can be brought into contact with the grip portion 212 of the toner container 200 installed in the corresponding installation portion 30. When the container body 201 rotates in the second direction D7, the first lever portion 71 comes into contact with the grip portion 212 and swings counter-clockwise in FIG. 9. This causes the pushing portion 71C of the first lever portion 71 to push the pressure receiving portion 72C of the second lever portion 72 upward and thus causes the support portion 72B of the second lever portion 72 and the engagement portion 64 to swing downward. As a result, the engaging portion 63 disengages from the engagement portion 64. That is, the lock by the locking mechanism 34 is released. It is noted that, when the container body 201 rotates in the first direction D6, the first lever portion 71 comes into contact with the grip portion 212 and swings clockwise in FIG. 9. However, the second lever portion 72 does not swing in conjunction with the first lever portion 71. Accordingly, the rotation of the container body 201 in the first direction D6 does not release the lock by the locking mechanism 34.

In a related art, a known image forming apparatus includes a protrusion disposed on and protruding radially outward from an outer peripheral surface of the grip portion 212. The protrusion rotates integrally with the storage portion 211 and comes into contact with the first lever portion 71.

However, the protrusion in the image forming apparatus according to the related art protrudes radially outward from the outer peripheral surface of the grip portion 212 and thus causes impact noise when the protrusion comes into contact with the first lever portion 71.

In contrast, in the image forming apparatus 100 according to the embodiment of the present disclosure, impact noise produced while the toner containers 200 are driven can be eliminated or minimized as described below.

[Configuration of Container Body 201]

Next, the container body 201 will be described with reference to FIGS. 11 to 23.

The grip portion 212 includes contact portions 224 that rotate integrally with the storage portion 211 to come into contact with the first lever portion 71. The contact portions 224 are provided for an outer peripheral part of the grip portion 212.

Specifically, the contact portions 224 each include a curved surface 224A extending from a first position P1 (see FIG. 12) on a reference circle 223 (see FIGS. 9 and 12) to a second position P2 (see FIG. 12) on the reference circle 223 to be curved outside the reference circle 223. The reference circle 223 is concentric with the rotation axis 203 and does not intersect with the first lever portion 71. The first position P1 opposes the second position P2 with the rotation axis 203 therebetween. The curved surfaces 224A have a shape that intersects with the first lever portion 71, that is, that can be brought into contact with the first lever portion 71.

Figure 11:
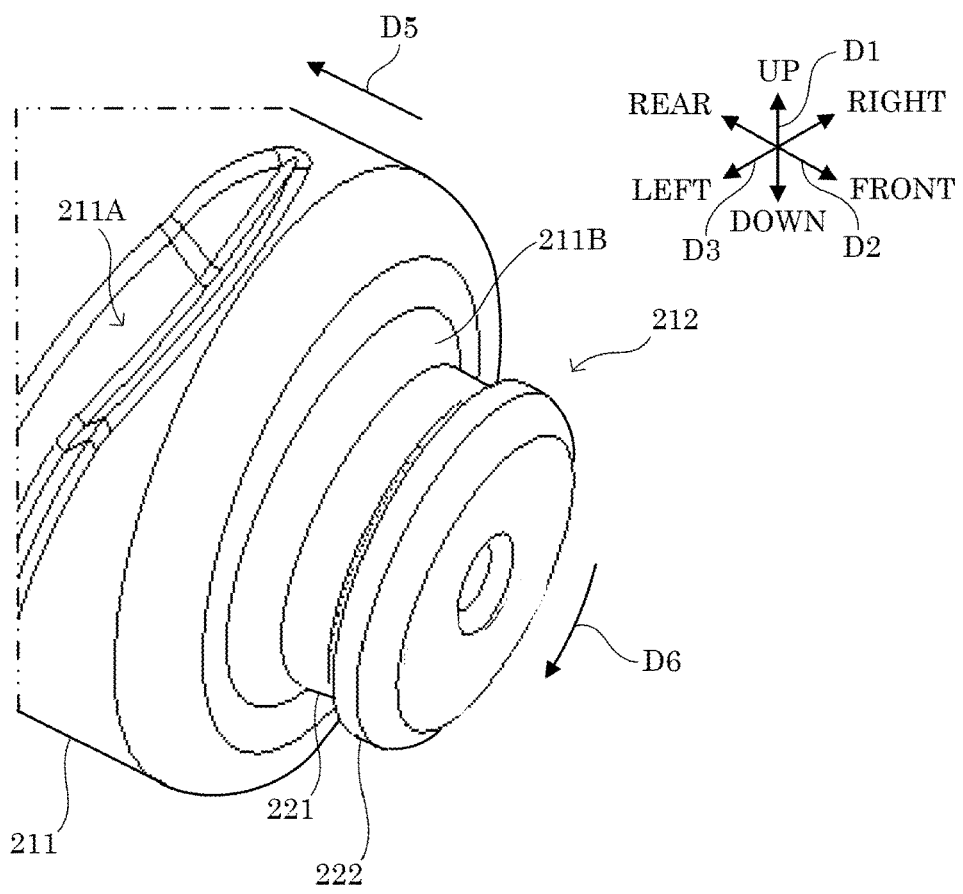
FIG. 11 is a perspective view showing a configuration of a grip portion of the image forming apparatus according to the embodiment of the present disclosure.
Figure 12:
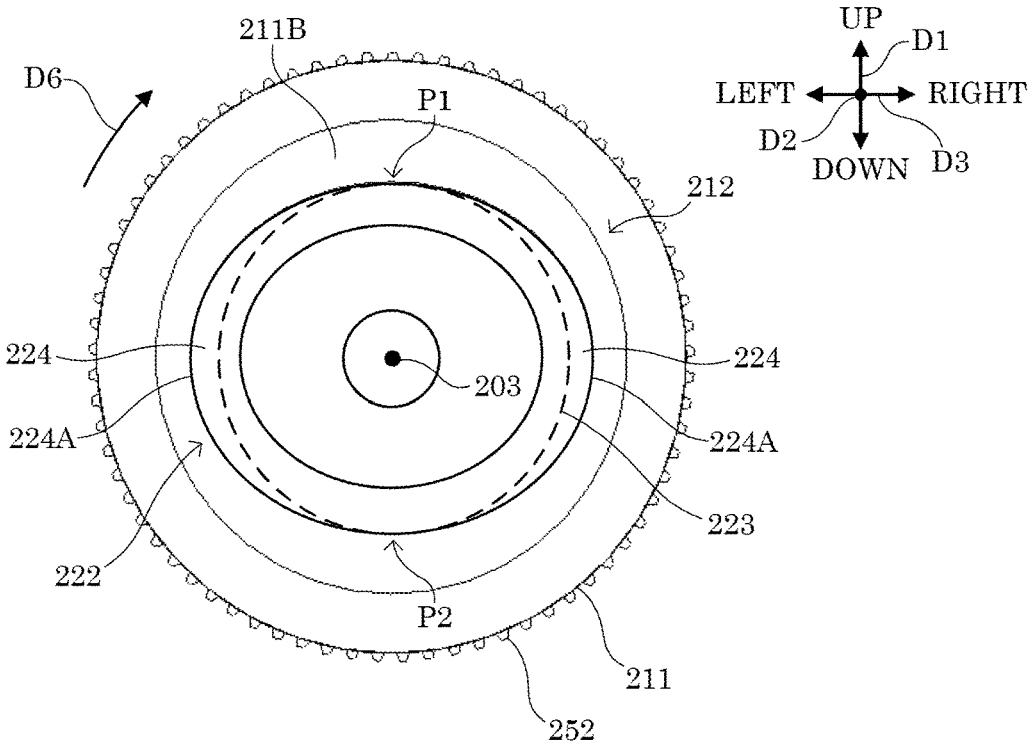
FIG. 12 is a front view showing the configuration of the grip portion of the image forming apparatus according to the embodiment of the present disclosure.

As shown in FIGS. 11 and 12, the large diameter portion 222 of the grip portion 212 has an elliptic cylindrical shape coaxial to the rotation axis 203. The contact portions 224 are expanded portions included in the large diameter portion 222 and expanded from the reference circle 223. That is, the large diameter portion 222 is provided with the pair of contact portions 224 that oppose each other with the rotation axis 203 therebetween. It is noted that the small diameter portion 221 of the grip portion 212 is also elliptic cylindrical as does the large diameter portion 222.

Due to the above-described contact portions 224, the contact surfaces with the first lever portion 71 provided for the outer peripheral part of the grip portion 212 can be tilted to the extent possible. This eliminates or minimizes the impact noise produced when the contact portions 224 come into contact with the first lever portion 71. Accordingly, the image forming apparatus 100 can eliminate or minimize the impact noise produced while the toner containers 200 are driven.

The number of contact portions 224 provided for the outer peripheral part of the grip portion 212 may be one, or more than two. In this case, the small diameter portion 221 may have a shape similar to that of the large diameter portion 222 including the contact portions 224 or may be cylindrical. In addition, the grip portion 212 may be formed without expanding in radial directions from the proximal end to the distal end. In addition, the contact portions 224 may be provided for an outer peripheral part of the storage portion 211.

In a related art, a developer storage container is known to guide the toner inside the storage portion 211 to the communication portion 214 by connecting a tapered end of the storage portion 211 on the downstream side in the conveying direction D5 to the communication portion 214 and forming the protrusion 211A to the connection part with the communication portion 214 in the conveying direction D5.

However, in the developer storage container according to the related art, the conveying force applied to the toner by the protrusion 211A formed in the connection part is low, and thus the tone remains in the communication portion 214 at the time of replacement of the container.

In addition, the toner also remains in the communication portion 214 at the time of replacement of the developer storage container in a case where the communication portion 214 is not provided with a configuration for conveying toner.

In contrast, in the image forming apparatus 100 according to the embodiment of the present disclosure, the toner remaining in the toner containers 200 at the time of replacement of the containers can be reduced as described below.

Figure 14:
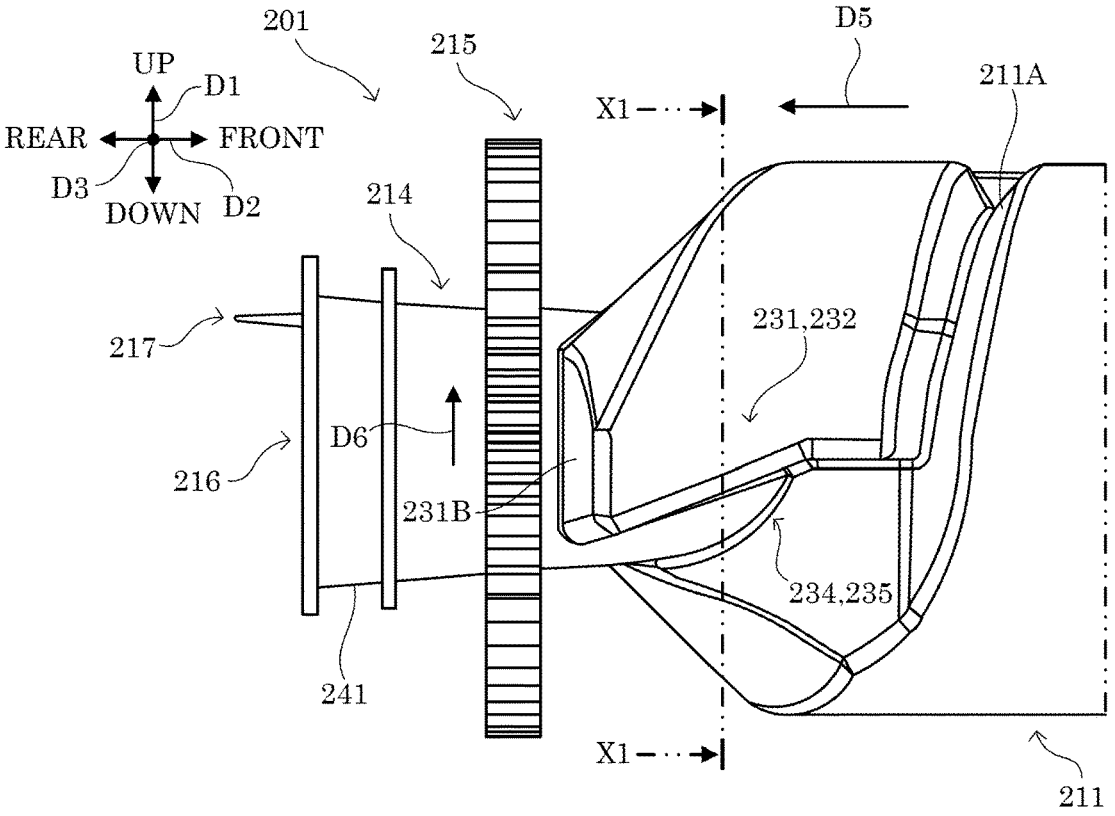
FIG. 14 is a side view showing the configuration of the scooping portion of the image forming apparatus according to the embodiment of the present disclosure.

Specifically, as shown in FIGS. 13 and 14, the end of the storage portion 211 on the downstream side in the conveying direction D5 is provided with scooping portions 231 and guide portions 234. In addition, an inner peripheral part of the communication portion 214 gradually increases its diameter in the conveying direction D5 (see FIG. 21). The features will be described in order below.

Figure 15:
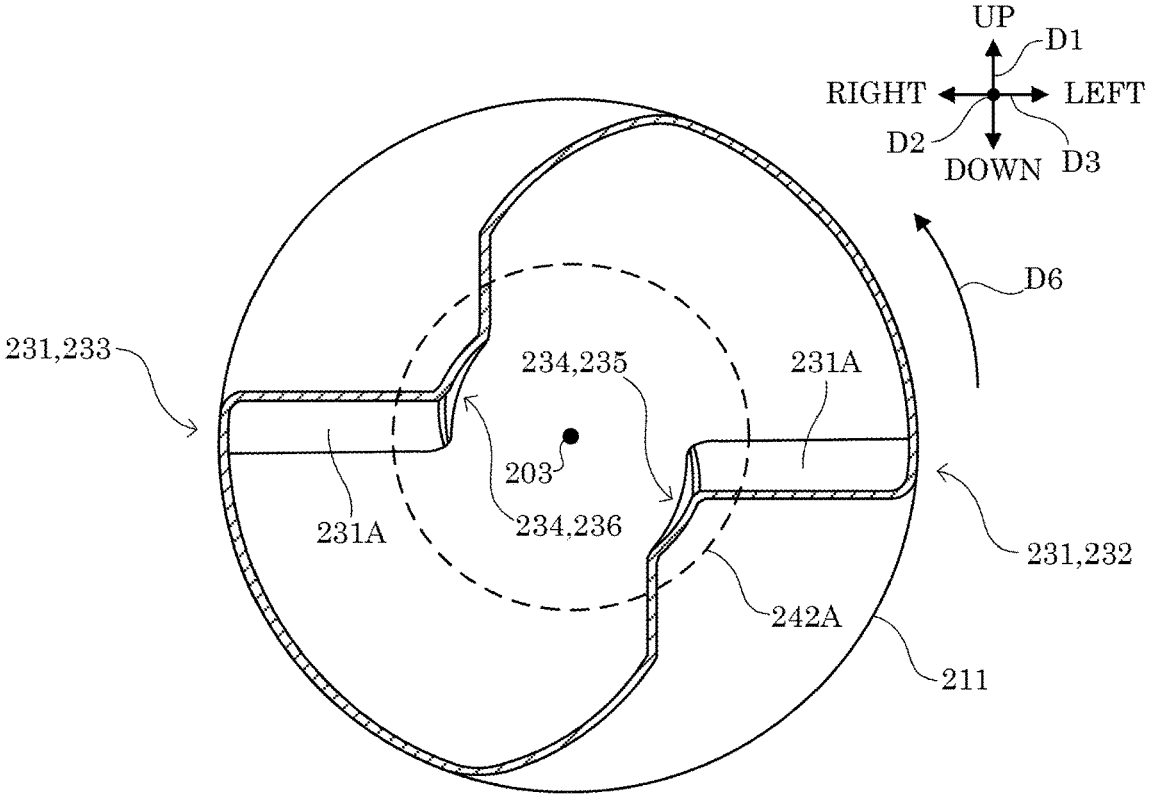
FIG. 15 is a cross-sectional view taken along line X1-X1 in FIG. 14.

The scooping portions 231 each include a scooping surface 231A (see FIGS. 14 and 15) that faces the first direction D6 at the end of the storage portion 211 on the downstream side in the conveying direction D5 and radially outside the communication portion 214. The scooping portions 231 scoop up the toner that is in contact with the scooping surfaces 231A as the storage portion 211 rotates in the first direction D6. In FIG. 15, a broken line indicates an end 242A of the communication portion 214 in an inner peripheral part 242 on the upstream side in the conveying direction D5.

The scooping surfaces 231A are inclined upstream in the first direction D6 along the conveying direction D5. This guides the toner scooped up by the scooping surfaces 231A downstream in the conveying direction D5.

The scooping portions 231 each include a wall portion 231B (see FIGS. 14 and 16) raised in the first direction D6 from an end of the corresponding scooping surface 231A on the downstream side in the conveying direction D5, and the inner radial end of each wall portion 231B is inclined in the conveying direction D5 compared with the outer radial end. The wall portions 231B guide the toner scooped up by the scooping surfaces 231A radially inward, that is, to the communication portion 214.

The guide portions 234 guide the toner scooped up by the scooping portions 231 to the communication portion 214. Specifically, as the storage portion 211 rotates in the first direction D6, the toner slides down the scooping surfaces 231A inclined radially inward and downward. The guide portions 234 guide the toner to the communication portion 214.

As shown in FIGS. 13 to 16, the guide portions 234 are disposed radially inside the scooping portions 231 to be contiguous with the scooping surfaces 231A and the inner peripheral surface of the communication portion 214.

As shown in FIGS. 14 and 15, the guide portions 234 are included from the inner radial ends of the scooping surfaces 231A along the inner peripheral surface of the communication portion 214.

Figure 16:
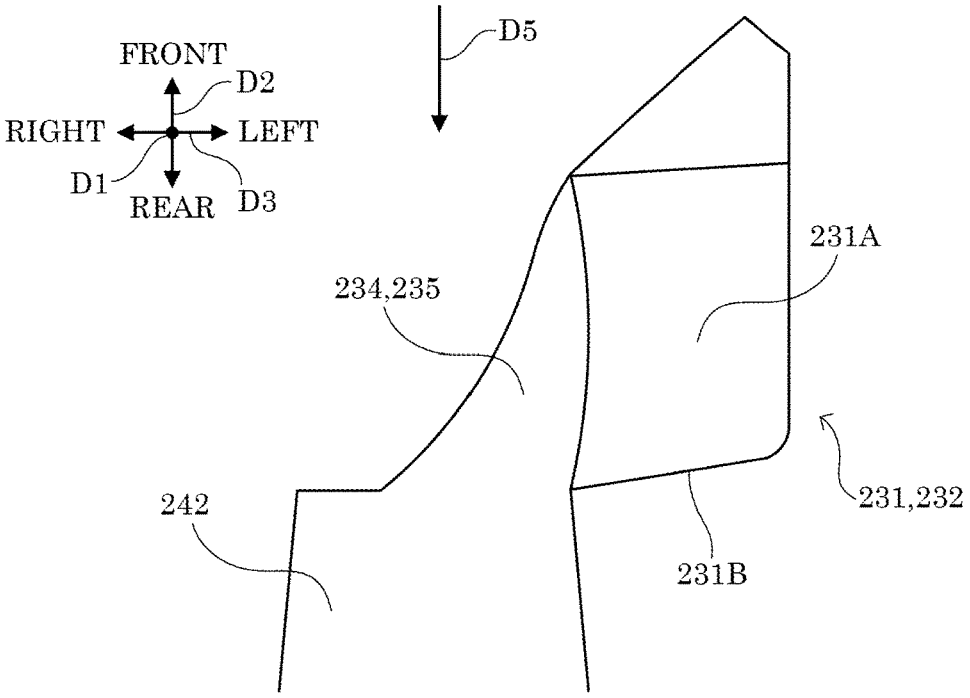
FIG. 16 is a plan view showing the configuration of the scooping portion of the image forming apparatus according to the embodiment of the present disclosure.

As shown in FIG. 16, the guide portions 234 widen from ends of the scooping surfaces 231A on the upstream side in the conveying direction D5 toward the communication portion 214.

The storage portion 211 includes the pair of scooping portions 231 (see FIG. 15) that oppose each other with the rotation axis 203 therebetween. A first scooping portion 232, which is one of the pair of scooping portions 231, is contiguous with an end of the protrusion 211A on the downstream side in the conveying direction D5 (see FIG. 14). A second scooping portion 233, which is the other of the pair of scooping portions 231, is not contiguous with the protrusion 211A of the storage portion 211 (see FIG. 13).

The storage portion 211 further includes the pair of guide portions 234 (see FIG. 15) respectively corresponding to the pair of scooping portions 231. A first guide portion 235, which is one of the pair of guide portions 234, corresponds to the first scooping portion 232. A second guide portion 236, which is the other of the pair of guide portions 234, corresponds to the second scooping portion 233.

The scooping portions 231 and the guide portions 234 described above enable the toner inside the storage portion 211 to slide down from a position above the rotation axis 203 toward the communication portion 214. Thus, the toner can be conveyed to the communication portion 214 with higher conveying force compared with the configuration in which the toner is conveyed to the communication portion 214 using the protrusion 211A that extends to the connection part with the communication portion 214. This can reduce the toner remaining inside the toner container 200 at the time of replacement of the container.

The number of scooping portions 231 provided for the storage portion 211 may be more than two. In this case, the number of guide portions 234 may correspond to the number of scooping portions 231. In addition, only one of the first scooping portion 232 and the second scooping portion 233 in the scooping portions 231 may be provided for the storage portion 211.

The guide portions 234 may widen from positions downstream of the ends of the scooping surfaces 231A on the upstream side in the conveying direction D5 toward the communication portion 214. In addition, the inner radial ends of the wall portions 231B may not necessarily be inclined in the conveying direction D5 compared with the outer radial ends. In addition, the scooping surfaces 231A may not necessarily be inclined upstream in the first direction D6 along the conveying direction D5.

Figure 21:
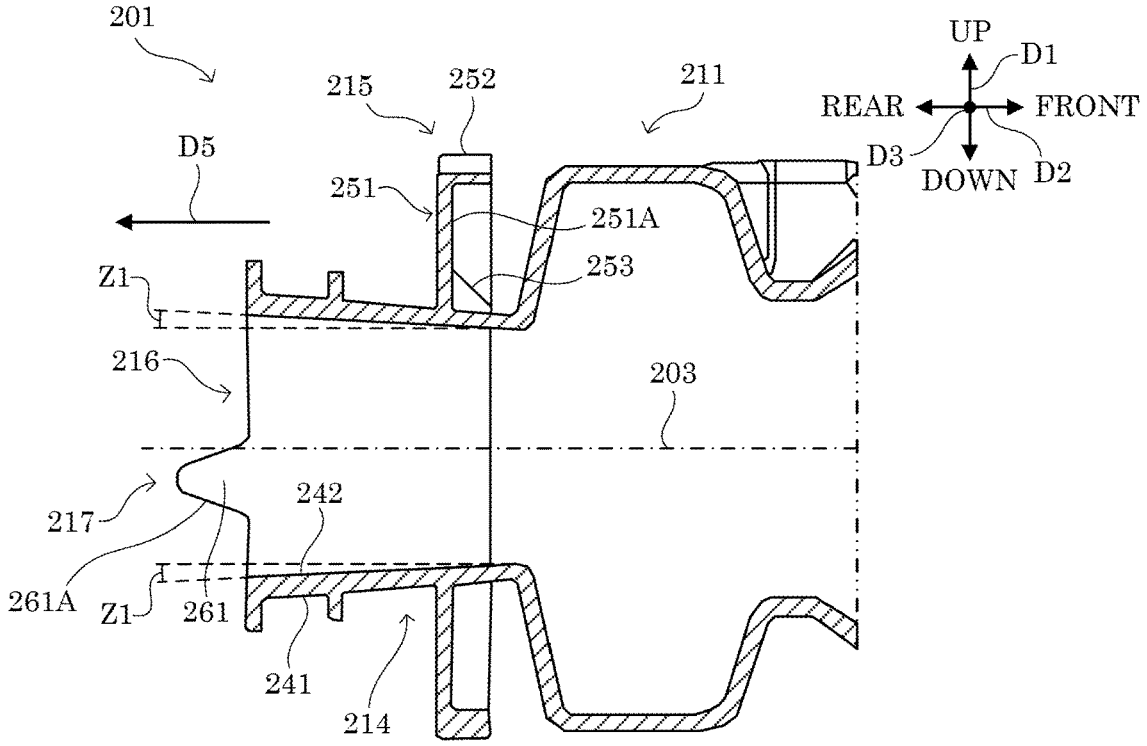
FIG. 21 is a cross-sectional view showing the configuration around the communication portion of the image forming apparatus according to the embodiment of the present disclosure.

As shown in FIG. 21, the inner peripheral part 242 of the communication portion 214 is inclined radially outward at a specific angle Z1 along the conveying direction D5. For example, the specific angle Z1 is set in any desired range up to 10 degrees.

The communication portion 214 includes six ridges 243 (see FIG. 18) extending in the inner peripheral part 242 along the rotation axis 203.

Figure 18:
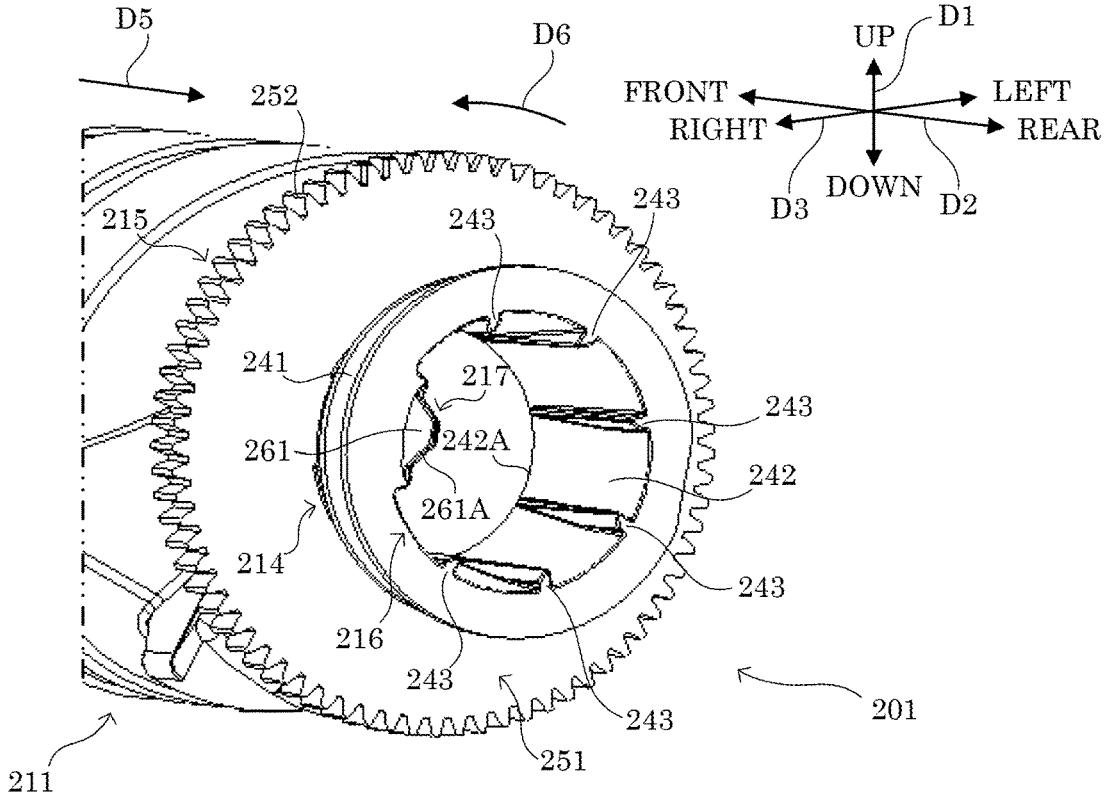
FIG. 18 is a perspective view showing the configuration around the communication portion of the image forming apparatus according to the embodiment of the present disclosure.
Figure 19:
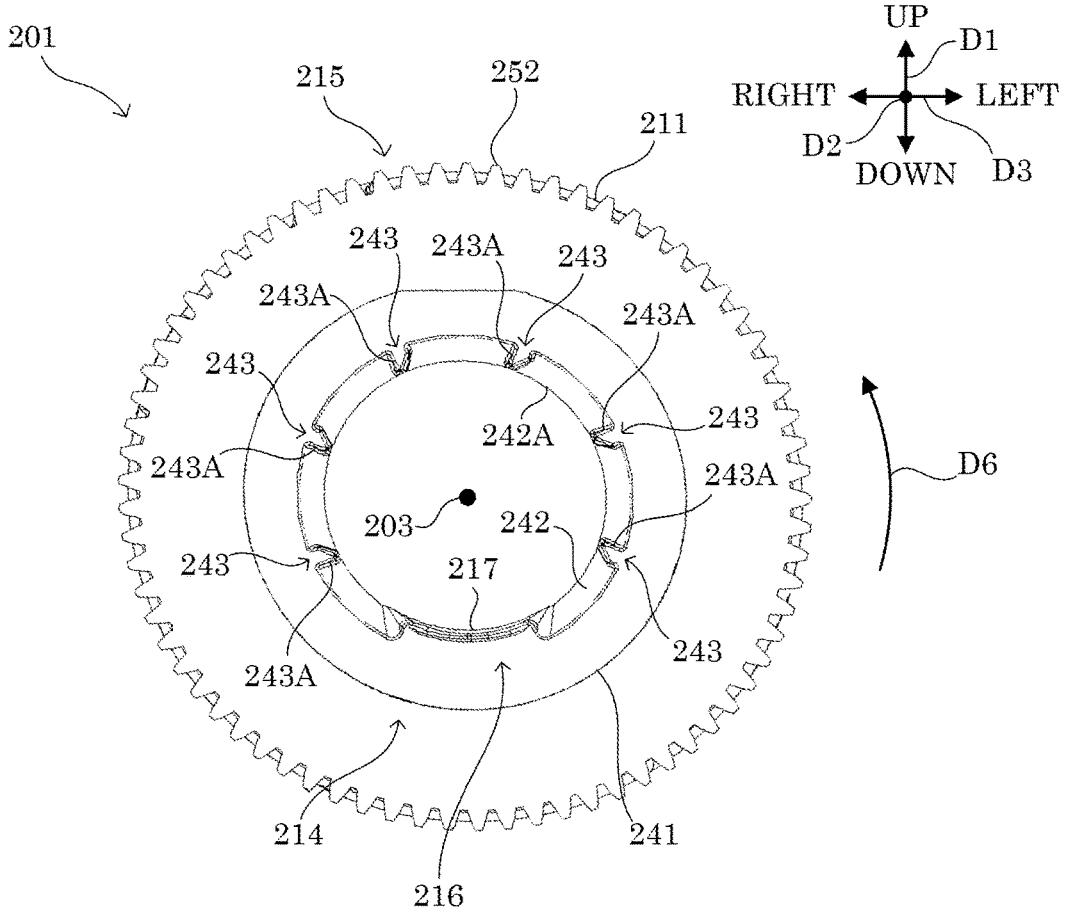
FIG. 19 is a rear view showing a configuration of an opening portion of the image forming apparatus according to the embodiment of the present disclosure.

As shown in FIGS. 18 and 19, the six ridges 243 are separated from each other along the inner perimeter of the inner peripheral part 242.

As shown in FIG. 18, the ridges 243 extend from the end 242A of the inner peripheral part 242 on the upstream side in the conveying direction D5 to the downstream end, that is, the opening portion 216.

As shown in FIG. 19, the ridges 243 extend from the inner peripheral surface of the communication portion 214 in the conveying direction D5, which intersects with the inner peripheral surface. That is, the ridges 243 are located radially outside the end 242A in the inner peripheral part 242 on the upstream side in the conveying direction D5. For example, the apexes of the ridges 243 extend along lines passing through the end 242A and parallel to the rotation axis 203 (see FIG. 19). In this case, the height of the ridges 243 from the inner peripheral part 242 gradually increases in the conveying direction D5. This eliminates differences in level between the inner peripheral part 242 and ends of the ridges 243 on the upstream side in the conveying direction D5. That is, an impediment to the conveyance of the toner caused by the level differences can be prevented.

As shown in FIG. 19, the ridges 243 each include a wall surface 243A facing downstream in the first direction D6. The wall surfaces 243A scoop up the toner that is in contact with the wall surfaces 243A and let the toner slide down downward as the storage portion 211 rotates in the first direction D6.

As shown in FIG. 19, the ridges 243 have a claw-like shape of which the distal end faces downstream in the first direction D6. That is, the ridges 243 each include an inclined surface inclined from the inner radial end of the corresponding wall surface 243A toward the inner peripheral part 242 upstream in the first direction D6. Thus, the ridges 243 can be reduced in size compared with a configuration in which the ridges 243 include the wall surfaces 243A and wall surfaces facing upstream in the first direction D6.

The above-described inner peripheral part 242 enables the toner inside the communication portion 214 to slide down downstream in the conveying direction D5. In addition, the ridges 243 scoop up and drop the toner to bring the dropped toner into contact with the inner peripheral part 242. Thus, the conveying force in the conveying direction D5 converted from the energy of the dropped toner can be applied to the toner.

It is noted that the ridges 243 may be formed in any desired section between the opening portion 216 and the end 242A in the inner peripheral part 242 on the upstream side in the conveying direction D5. In addition, the ridges 243 extending in the conveying direction D5 may have a fixed height from the inner peripheral part 242. In addition, the ridges 243 may have any shape that extends in the inner peripheral part 242 along the rotation axis 203. In addition, the number of ridges 243 provided for the inner peripheral part 242 may be any number including zero.

In a related art, a known image forming apparatus includes a stirring member extending downstream in the conveying direction D5 from inside the container body 201 beyond the opening portion 216 to prevent the toner adhering to the cap portion 202 (see FIG. 22) from hardening.

However, the container body 201 and the stirring member in the image forming apparatus according to the related art are separate members, and the stirring member needs to be attached to the container body 201 during the production of the developer storage container at great expense in time and effort.

In contrast, in the image forming apparatus 100 according to the embodiment of the present disclosure, the time and effort required during the production of the toner container 200 can be reduced as described below.

Figure 17:
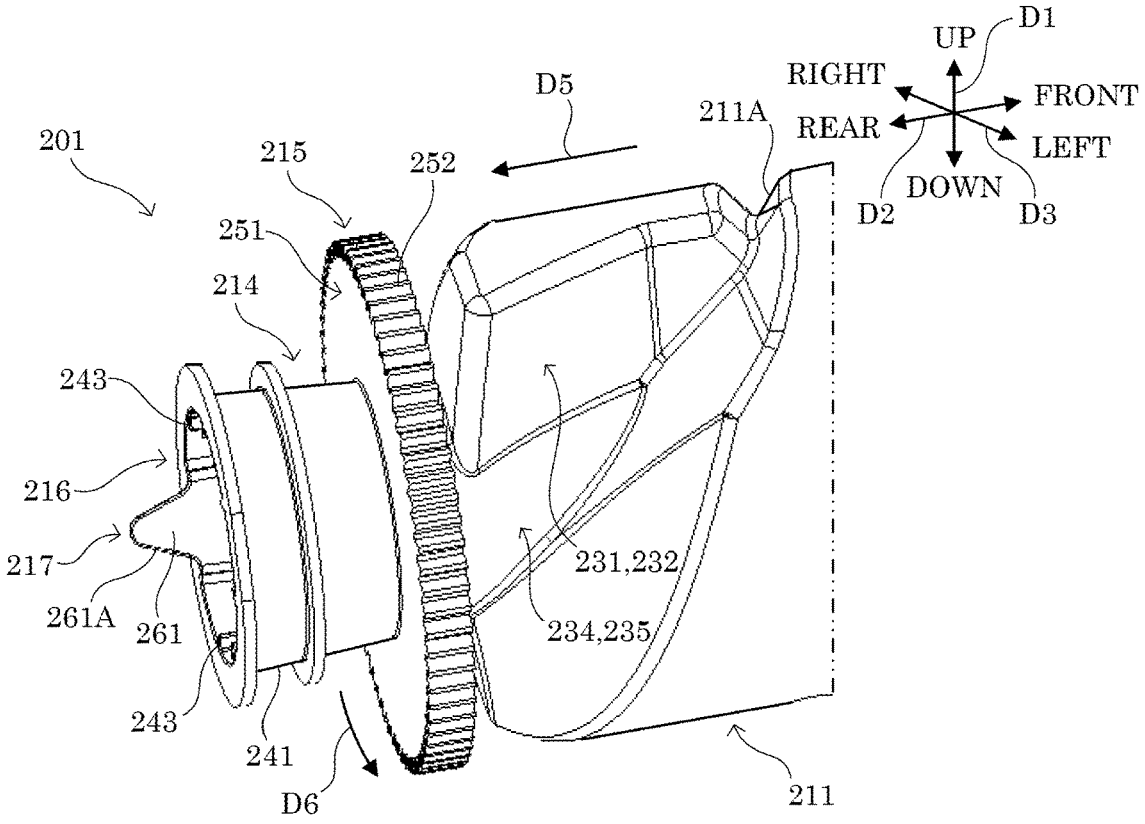
FIG. 17 is a perspective view showing a configuration around a communication portion of the image forming apparatus according to the embodiment of the present disclosure.

As shown in FIG. 17, the container body 201 includes an extension portion 217.

The extension portion 217 is integral to the container body 201. The extension portion 217 extends downstream in the conveying direction D5 from inside the container body 201 beyond the opening portion 216.

As shown in FIGS. 18 and 19, the extension portion 217 has a thin, smooth shape extending along the inner peripheral surface of the communication portion 214, and the proximal end of the extension portion 217 is supported by the inner peripheral part 242 of the communication portion 214. This can increase the support area of the proximal end of the extension portion 217 in the inner peripheral part 242. In addition, the extension portion 217 can be prevented from impeding the movement of the toner inside the communication portion 214.

As shown in FIGS. 17 and 18, the extension portion 217 includes an exposed portion 261 exposed to the outside of the container body 201, and an end face 261A of the exposed portion 261 on the downstream side in the first direction D6 is inclined upstream in the first direction D6 along the conveying direction D5. For example, the exposed portion 261 is substantially triangular (see FIG. 17) when viewed from the side. This configuration can distribute a force exerted on the proximal end of the extension portion 217 in the first direction D6 when the extension portion 217 comes into contact with the toner adhering to the inner wall of the cap portion 202. Accordingly, the durability of the extension portion 217 can be increased.

Figure 20:
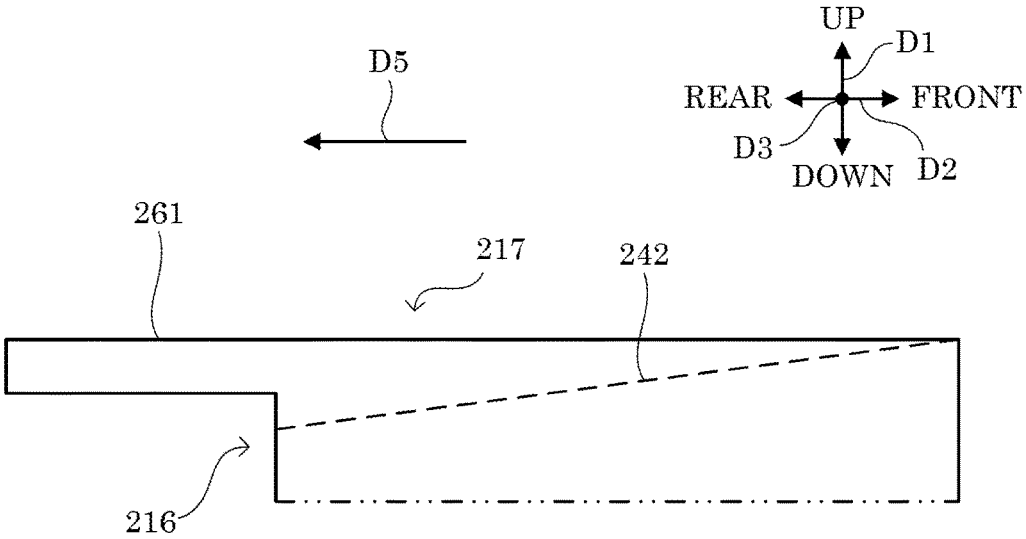
FIG. 20 is a cross-sectional view showing a configuration of an extension portion of the image forming apparatus according to the embodiment of the present disclosure.

As shown in FIGS. 19 and 20, as do the ridges 243, the extension portion 217 extends from the inner peripheral surface of the communication portion 214 in the conveying direction D5, which intersects with the inner peripheral surface. That is, the extension portion 217 is located radially outside the end 242A in the inner peripheral part 242 on the upstream side in the conveying direction D5. For example, a part of the extension portion 217 opposing the rotation axis 203 extends along a line passing through the end 242A and parallel to the rotation axis 203 (see FIG. 19). In addition, part of the extension portion 217 extending from the opening portion 216 downstream in the conveying direction D5 has a predetermined thickness in directions orthogonal to the rotation axis 203 (see FIGS. 19 and 20). This eliminates a difference in level between the inner peripheral part 242 and an end of the extension portion 217 on the upstream side in the conveying direction D5. That is, an impediment to the conveyance of the toner caused by the level difference can be avoided.

The above-described extension portion 217 does not require attachment work during the production of the toner container 200. Accordingly, time and effort required during the production of the toner container 200 can be reduced.

It is noted that the extension portion 217 extending in the conveying direction D5 may have a fixed height from the inner peripheral part 242. In addition, the exposed portion 261 may have any shape. In addition, the extension portion 217 may have a shape different from the thin, smooth shape extending along the inner peripheral surface of the communication portion 214.

In a typical image forming apparatus, heat generated while the apparatus body is driven is often transferred to the storage portions 211 via the gear portions 215. In this case, the toner inside the storage portions 211 is heated and becomes easier to harden.

In contrast, in the image forming apparatus 100 according to the embodiment of the present disclosure, heat transfer from the body through the gear portions 215 can be prevented as described below.

Figure 23:
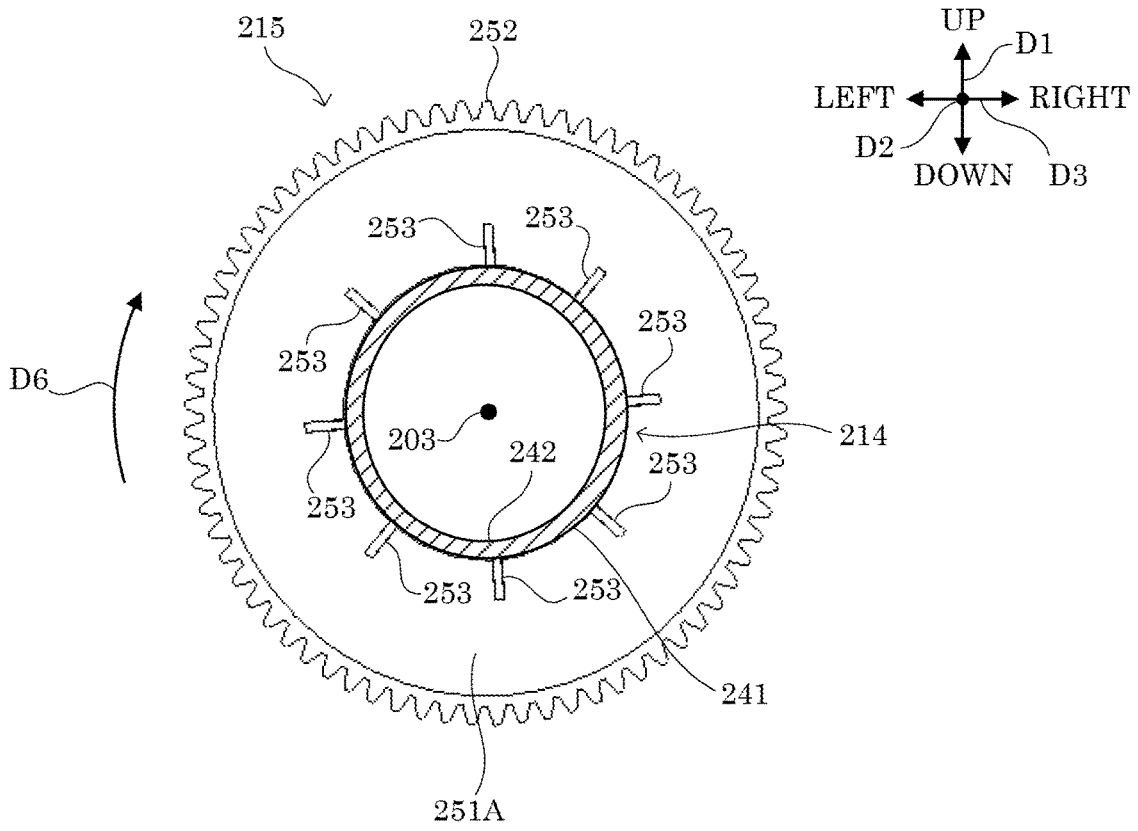
FIG. 23 is a cross-sectional view showing a configuration of a gear portion of the image forming apparatus according to the embodiment of the present disclosure.

As shown in FIGS. 21 and 23, the gear portion 215 includes a support portion 251, a tooth portion 252, and eight ribs 253.

As shown in FIGS. 21 and 23, the support portion 251 has a disc shape and is provided for the outer peripheral part 241 of the communication portion 214 to be concentric with the rotation axis 203.

As shown in FIGS. 21 and 23, the tooth portion 252 extends along the edge of a support surface 251A, orthogonal to the conveying direction D5, of the support portion 251. The support surface 251A is a surface of the support portion 251 on the upstream side in the conveying direction D5. The tooth portion 252 includes an annular support portion formed along the edge of the support surface 251A and teeth formed on the outer peripheral surface of the support portion. The tooth portion 252 meshes with the third gear 45 of the corresponding drive portion 32.

As shown in FIGS. 21 and 23, the ribs 253 extend on the support surface 251A radially from the outer peripheral part 241 of the communication portion 214. As shown in FIG. 21, the ribs 253 are inclined radially outward along the conveying direction D5. As shown in FIG. 23, the protruding ends of the ribs 253 do not reach the tooth portion 252. This prevents heat transfer from the tooth portion 252 to the communication portion 214 through the ribs 253 without the involvement of the support portion 251.

As shown in FIG. 23, the gear portion 215 includes the eight ribs 253 arranged at regular intervals along the outer peripheral surface of the communication portion 214. The number of ribs 253 provided for the gear portion 215 may be any number.

Here, as shown in FIGS. 12, 14, and 19, the addendum circle of the gear portion 215 has a larger diameter than the storage portion 211. Thus, unlike a configuration in which the diameter of the addendum circle is smaller than the diameter of the storage portion 211, the gear portion 215 can be positioned on a travel path of an air current produced in the conveying direction D5 by the rotation of the storage portion 211 and can be cooled by the air current. In addition, the gear portion 215 prevents the air current from flowing downstream in the conveying direction D5 beyond the gear portion 215, thereby preventing toner leaking from the cap portion 202 from being scattered.

In addition, in the gear portion 215, the tooth portion 252 and the ribs 253 are disposed on the support surface 251A of the support portion 251 on the upstream side in the conveying direction D5. This increases the contact area between the air current and the gear portion 215 compared with a configuration in which the tooth portion 252 and the ribs 253 are disposed on a surface of the support portion 251 on the downstream side in the conveying direction D5. That is, the effect of cooling the gear portion 215 by the air current can be increased. In addition, the air current that has reached the support surface 251A can be guided along the shape of the gear portion 215 in a direction opposite the conveying direction D5. This prevents the air current from flowing downstream in the conveying direction D5 beyond the gear portion 215 more effectively.

The above-described gear portion 215 can eliminate or minimize heat transfer from the body through the gear portion 215.

The addendum circle of the gear portion 215 may have a smaller diameter than the storage portion 211. In addition, the support surface 251A may be a surface of the support portion 251 on the downstream side in the conveying direction D5. In addition, the ribs 253 may extend on the support surface 251A radially from the tooth portion 252. In addition, the ribs 253 may be provided for both the tooth portion 252 and the outer peripheral part 241 of the communication portion 214.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer storage container positioned such that a rotation axis of the developer storage container is parallel to a horizontal plane during use, the developer storage container comprising:

a storage portion configured to convey developer stored inside the storage portion in a conveying direction parallel to the rotation axis by being rotated around the rotation axis in a specific direction;

a communication portion having a tubular shape that is coaxial to the rotation axis and that extends in the conveying direction from an end of the storage portion on a downstream side in the conveying direction and connecting the storage portion to an opening portion that has an opening facing the conveying direction; and a gear portion including a support portion that has a disc shape and that is provided for an outer peripheral part of the communication portion to be concentric with the rotation axis, a tooth portion that extends along an edge of a support surface, orthogonal to the conveying direction, of the support portion, and a rib that extends on the support surface radially from one of the tooth portion and the outer peripheral part of the communication portion without reaching the other; and configured to receive a rotational driving force supplied from an outside.

2. The developer storage container according to claim 1, wherein the rib is provided for one of the tooth portion and the outer peripheral part of the communication portion.

3. The developer storage container according to claim 1, wherein the support surface is a surface on an upstream side in the conveying direction.

4. The developer storage container according to claim 3, wherein the storage portion has a tubular shape that is coaxial to the rotation axis and that has a larger diameter than the communication portion, and an addendum circle of the gear portion has a larger diameter than the storage portion.

5. An image forming apparatus, comprising:

the developer storage container according to claim 1; and an image forming portion configured to form an image using the developer supplied from the developer storage container.

* * * * *